US006595815B2

(12) United States Patent
Au et al.

(10) Patent No.: US 6,595,815 B2
(45) Date of Patent: Jul. 22, 2003

(54) WATERCRAFTS WITH ACTIVE HULLS ATTAIN SUBSTANTIAL HYDRODYNAMIC DRAG REDUCTION

(76) Inventors: Ching Yin Au, P.O. Box 31205, Greenwich, CT (US) 06831-0905; Lawrence Au, 1908 Eaton Dr., Vienna, VA (US) 22182

( * ) Notice: Subject to any disclaimer, the term of this patent is extended or adjusted under 35 U.S.C. 154(b) by 0 days.

(21) Appl. No.: 09/853,685

(22) Filed: May 14, 2001

(65) Prior Publication Data

US 2003/0032348 A1 Feb. 13, 2003

(51) Int. Cl.[7] ..... B63H 1/04
(52) U.S. Cl. ..... 440/90
(58) Field of Search ..... 440/90–92, 98–100

(56) References Cited

U.S. PATENT DOCUMENTS 2,309,875 A * 2/1943 Thompson ..... 440/100
2,488,310 A * 11/1949 Mayer ..... 440/100
5,299,523 A * 4/1994 Kovacs et al. ..... 440/100

FOREIGN PATENT DOCUMENTS

JP 1223094 * 9/1989

* cited by examiner

*Primary Examiner*—Ed Swinehart

(57) ABSTRACT

Watercrafts comprising rotatable hulls that serve as propulsors. The hulls are rotors with paddle surfaces and are arranged three-dimensionally to gain the capability of actively diverting water toward the side and the rear, for the purpose of drastically reducing frontal drag and the capability of minimizing friction drag on their wetted surfaces. Watercrafts with rotatable hulls are essentially amphibious.

5 Claims, 11 Drawing Sheets

WATERCRAFTS WITH ACTIVE HULLS ATTAIN SUBSTANTIAL HYDRODYNAMIC DRAG REDUCTION

BACKGROUND OF THE INVENTION

Multihull watercrafts like the catamaran and the trimaran have been a popular alternative to the monohull version. The hulls are usually rigid and inactive. The arrangement of the hulls gives them good lateral stability. However, there is one type of very small watercrafts that have active hulls. A typical craft of this type has four very large lightly constructed plastic tires which resemble over-sized automotive tires. In fact, the craft's arrangement of its tires is similar to that of an automobile. The tires are used for floatation and, with deep and wide crosswise grooves instead of the conventional random shallow grooves, are also used for propulsion as the tires are rotated by bicycle type foot paddle mechanisms. The buoyancy and propulsive ability of its tires qualify such craft as active hulls. Such crafts are lacking in propulsive efficiency because it is difficult to provide the tires with adequate water pushing area. The tires, with their horizontal axles, have a high center of gravity which in turn compromises stability. Such crafts are mostly used as playthings in calm water near beaches and small lakes in resort areas.

Crafts with active hulls are useful because hulls that can float and propel possess some unusual properties.

The following describes methods by which multihull watercrafts can be constructed to have good propulsive efficiency and substantially reduce hydrodynamic drag.

BRIEF SUMMARY OF THE INVENTION

By referring to watercraft with active hulls described in the previous section, a brief summary of the invention can be presented more clearly and concisely by describing, in a step-by-step fashion, the changes and improvements achieved by the crafts in the present invention. The craft in prior art have two pairs of very large tire-shaped hulls with inadequate surfaces for efficient propulsion; their rotatable hulls, with their horizontal axles, have an excessively high center of gravity.

First, the present invention redesigns the tire-shaped hulls to each have their own individual axle with a power input end toward the center of the craft.

The second change rotates the tires and their axles upward approximately forty-five degrees, while holding the center of the tire-shaped hulls fixed.

At this point, a visualization of the front view of the craft will be helpful. From the front, only the front pair of the active hulls is visible. On each side of the vertical centerline of the craft lies a tire-shaped hull. Each tire-shaped hull with its axle is at a tilt, approximately forty-five degrees to a horizontal plane. The centerline of the axle of the right hull will intersect with the centerline of the axle of the left hull. The intersection is at the vertical centerline of the craft, above a horizontal line connecting the centers of hulls.

For simplicity, the frontal profile each tire-shaped hull can be represented by a rectangle. Since each tire-shaped hull is tilted approximately forty-five degrees, the rectangles representing them will also be tilted by the same angle. Since they are tilted, their total vertical height is reduced.

If a horizontal line representing the water level is placed somewhere above the lowest point of the tilted rectangle, the area of the rectangle(the outline of hull)is divided into two portions: one portion above water and one portion below water.

Further reduction of vertical height can be achieved by adjusting the proportions of the rectangle. The sides of the rectangle which are parallel to its axle can be lengthened until the rectangle becomes a square. The line of the rectangle nearest to axle's power-input end and perpendicular to the axle is reduced in length, to lower the highest point of the rectangle. Since the length of the line of the rectangle nearest to axle's power-input end is reduced, the ends of the two lengthened lines connected to it are brought closer together. At this point the rectangle has been transformed into a trapezoid.

The step to reduce the vertical height described in the last paragraph is not quite the last step. The trapezoid can be further refined by proportioning the trapezoid so the two inside angles adjacent to the trapezoid's longest side are forty-five degrees. This is a configuration that yields a minimum vertical protrusion height above water.

The trapezoid represents only the outline of the hull. In three dimensions, the hull is a hollow truncated watertight cone, truncated by an annular top plate with a hole for the axle, and bounded by a larger circular base plate.

With the reduction of vertical protrusion height done, the matter of propulsion is now addressed. The external conical surface of the active hulls is the ideal place to attach a number of rectangularly shaped paddles to endow the hull with water pushing ability. The paddles are thin rectangular plates with one of their long edges attached to the conical surface. The long edge of the rectangular plates extend from the edge of the base plate to the edge of the top plate. The flat surface of the plates is parallel to the centerline of the of conical hulls. Future paddles may be curved if such paddles can achieve smoother operation. As the conical hulls rotate around their centerline, one paddle after another will dip into the water. As the conical hull rotates, the paddle's wetted area increases until the wetted area reaches its maximum value when the paddle is the underwater vertical position. Water in contact with the wetted area on the advancing side of the paddles will be pushed; the water's reaction on the paddles gives the paddles their propulsive power.

The propulsive efficiency is a function of the rotational speed of the hull, the number of paddles and the dimension of the paddle's width. There is no problem expected in optimizing the three factors to achieve a good propulsive efficiency.

When the craft is operating on water, the hulls are partially immersed. The flat bases of the conical hulls are on the extreme right or left side of the craft. The bases are parallel to the direction of travel and are tilted upward to have an approximately forty five degrees with the surface of the water.

The base and the conical surface of each hull thus form a chisel shape as the hull moves through the water. An analysis of the water pushing action of the paddles and the special shape and orientation of the active hulls will reveal that a craft thus constructed can have a good propulsive efficiency and can attain a substantial reduction in drag.

Water normally resists the motion of passive hulls, the resistance showing up as frontal drag. In an active hull, this frontal drag is reduced by sweeping the water towards the rear with paddles. If the swept volume of the water is equal to the volume needed to move aside to the let the craft through, there will no frontal drag on the hull. In practice, some frontal drag will remain. A relatively small amount of energy expended by the paddles will move the water toward the center of the craft. This movement is not in the desired direction for propulsion. Later on, a method will be described for recovering part of this energy for forward propulsion.

The sweeping action requires the wetted portion of the conical surface of the hull to move rearward, on the average, almost as fast as the on-coming water. The conical surface of the hull thus encounter little friction drag.

The base plate of the rotating hulls, with its flat surface parallel to the direction of travel, will encounter no frontal drag but will encounter, on its wetted portion, some friction drag against its forward movement. The friction drag impeding forward movement at any point on the wetted surface is a function of the difference between the rearward speed of that point and the speed of travel. This speed difference varies as each point has a different radius measured from the center of rotation. At the lowest point of the base plate, the rearward speed is higher than the speed of travel so the speed difference is negative; the local friction drag is zero. The speed difference for the entire wetted surface has an average value that is smaller than the speed of travel. Since the friction drag is proportional to the one-and-a-half power of the speed difference, the rotation of the base plate substantially reduces substantially its friction drag compared to the friction drag on a stationary base plate.

The above orientation and rotational geometry enable the watercrafts with active hulls to attain a substantial reduction in hydrodynamic drag. So far, the descriptions and analyses are for a watercraft with two pairs of active hulls. A craft with one pair of active hulls and a central conventional hull can also have significant hydrodynamic advantages. Since the active hulls can carry a large fraction of the total weight, the central hull, with its reduced burden, will have less drag. A central hull can be designed to have surfaces to recover some of the energy wasted by the paddling of the rotating hulls. The arrangement of the hulls can be such that the bow waves made by the central hull are intercepted by the paddles of active hulls; energy in the waves can be recovered to boost the propulsive efficiency.

DETAILED DESCRIPTION OF THE INVENTION

Figure 1:
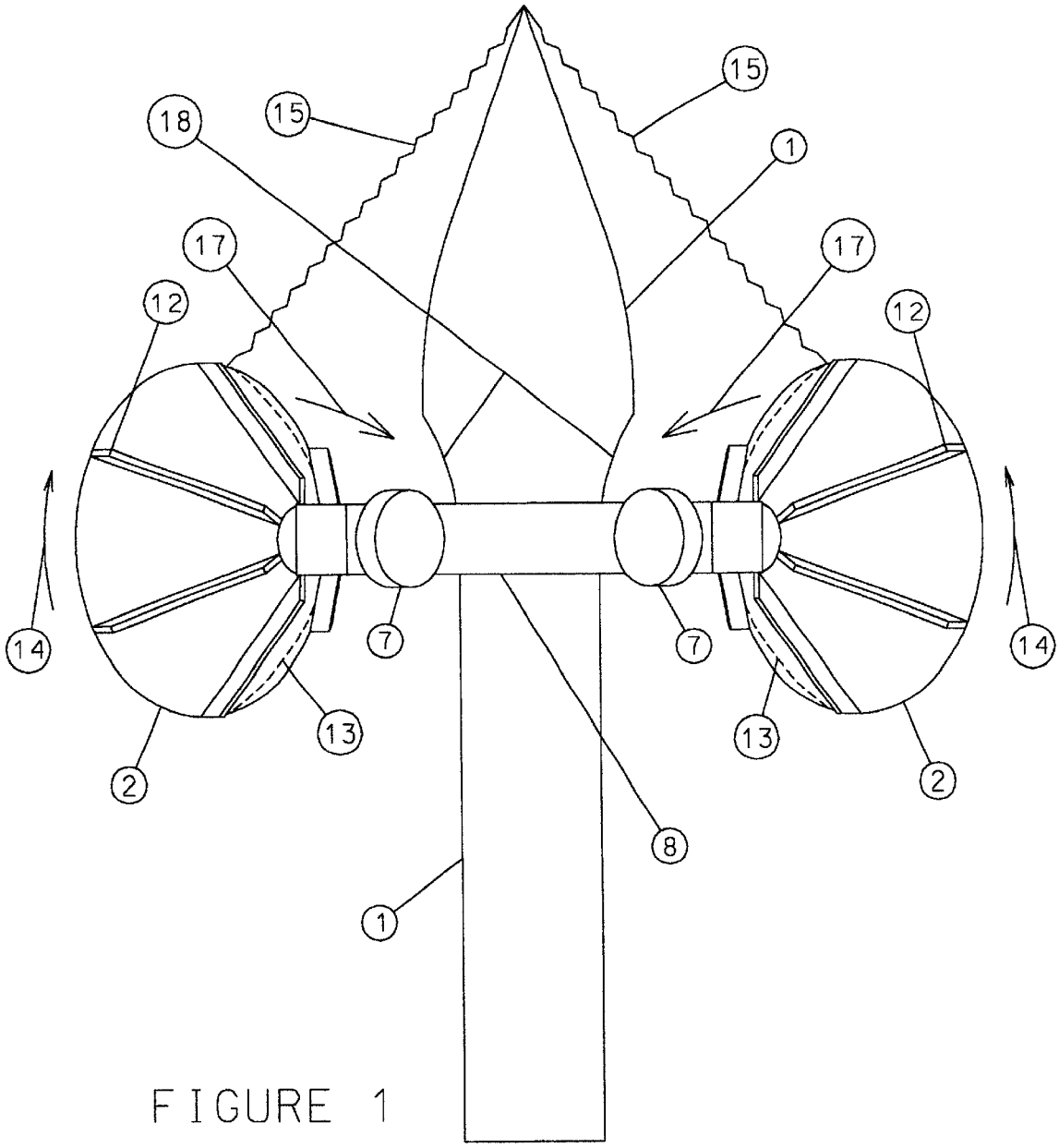
FIG. 1 is the plan view of a water craft with a pair of active hulls and a central hull.

FIG. 1 shows a watercraft with a pair of active hulls and a central hull. A conical active hull 2 with paddles 12 attached is shown at the right side of the central hull 1; an identical active hull 2 with paddles 12 is placed symmetrically at the left side. The paddles 12, as shown, have a shape of a trapezoids. The length of each of the four sides of the trapezoids can be made independently different for the sake of improved performance.

Figure 2:
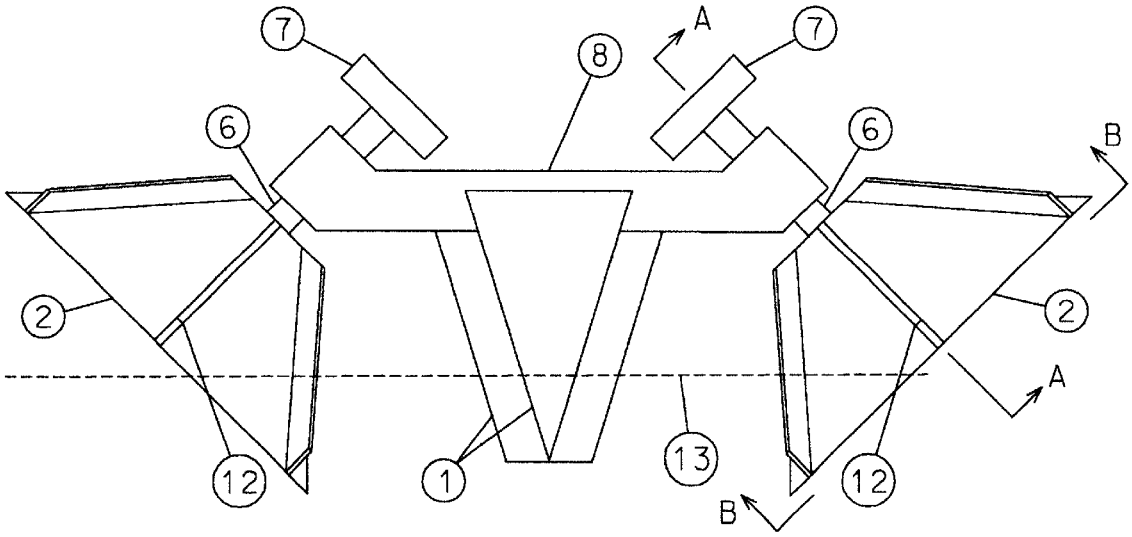
FIG. 2 is the elevation view of the craft in FIG. 1.

In FIG. 2, a central shaft 6 is shown attached to each of the active hulls 2 along their axis of symmetry, which is slanted upward approximately forty-five degrees relative to the water surface. An input pulley 7 is attached to each of central shafts 6 to provide a method of coupling to a power source, so that the active hull can be rotated (other methods of rotation can be used). The dashed line 13 shows the water level below which the active hulls are submerged.

In FIG. 1, arrows 14 show the direction of rotation of the active hulls. The rotation causes the paddles to dip into the water one after the other. With high enough rotational speed relative to the water speed, the paddles will push the water during the entire period of their immersion. A force of reaction from the water will be imposed on the paddle's surface where the water is being pushed. A paddle's water-pushing period can be divided into three characterizing portions: the first third, the middle third and the last third.

In the first third, the surface of the paddle pushed by the water is not oriented in the direction most effective for forward propulsion. The paddle's surface is not quite normal to the direction of craft's movement. In the middle third, the surface is very close to having the most effective orientation. The last third is similar to the first third. In the first third, the water is pushed in a direction that has a small component toward the center of the craft. This component is useless for propulsion. A small amount of energy is wasted.

Fortunately, in first third, the area of the surface where the water is being pushed is rather small, so the wasted energy is minimal. In the middle third, the water pushing area is maximal or near or at its maximum and has a favorable orientation. The bulk of the propulsion is derived from this third.

FIG. 1 and FIG. 2 show how one active hull is linked to the other and to the central hull by a lateral support beam 8. The central hull plays a part in increasing the overall propulsive efficiency. The parts of the hull near the active hulls have a inward slanting transitional surface 18. In the above discussion on the first third of the paddle's propulsion period, the paddles, due to their orientation, will push the water in the direction indicated by curved arrow 17. The water flows in a direction that has a component in the direction of the craft's travel which is related directly to the forward propulsive force. The water flow also has has a component perpendicular to the direction of the craft's travel; that component is useless for propulsion. However, when the water hits the inward slanting transitional surface, the water is forced to change its direction toward the rear. As a reaction, the water imposes on the transitional surface a force that has a useful component that pushes the central hull forward. Part of the otherwise wasted energy is recovered for propulsion. The overall propulsive efficiency is boosted.

Figure 3:
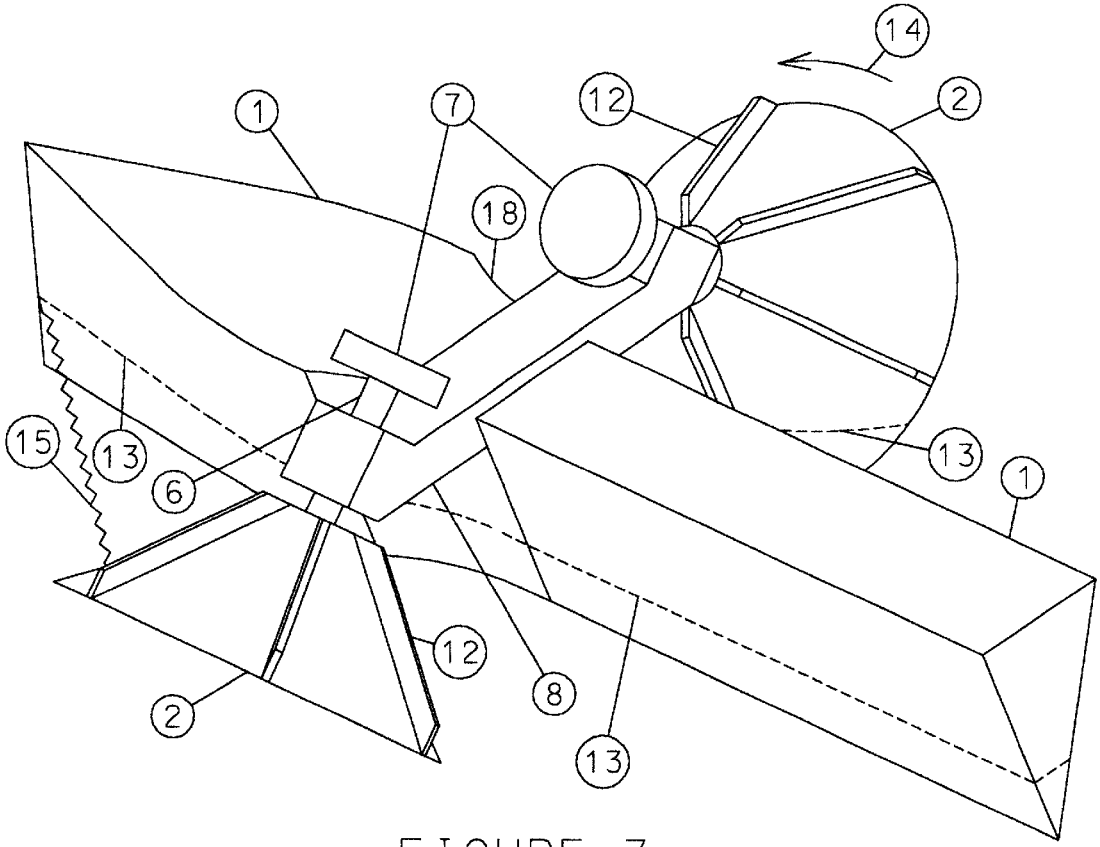
FIG. 3 is an isometric view of the craft in FIG. 1.

FIG. 3 is an isometric view of the craft. It shows the components more clearly in three dimensions.

Figure 4:
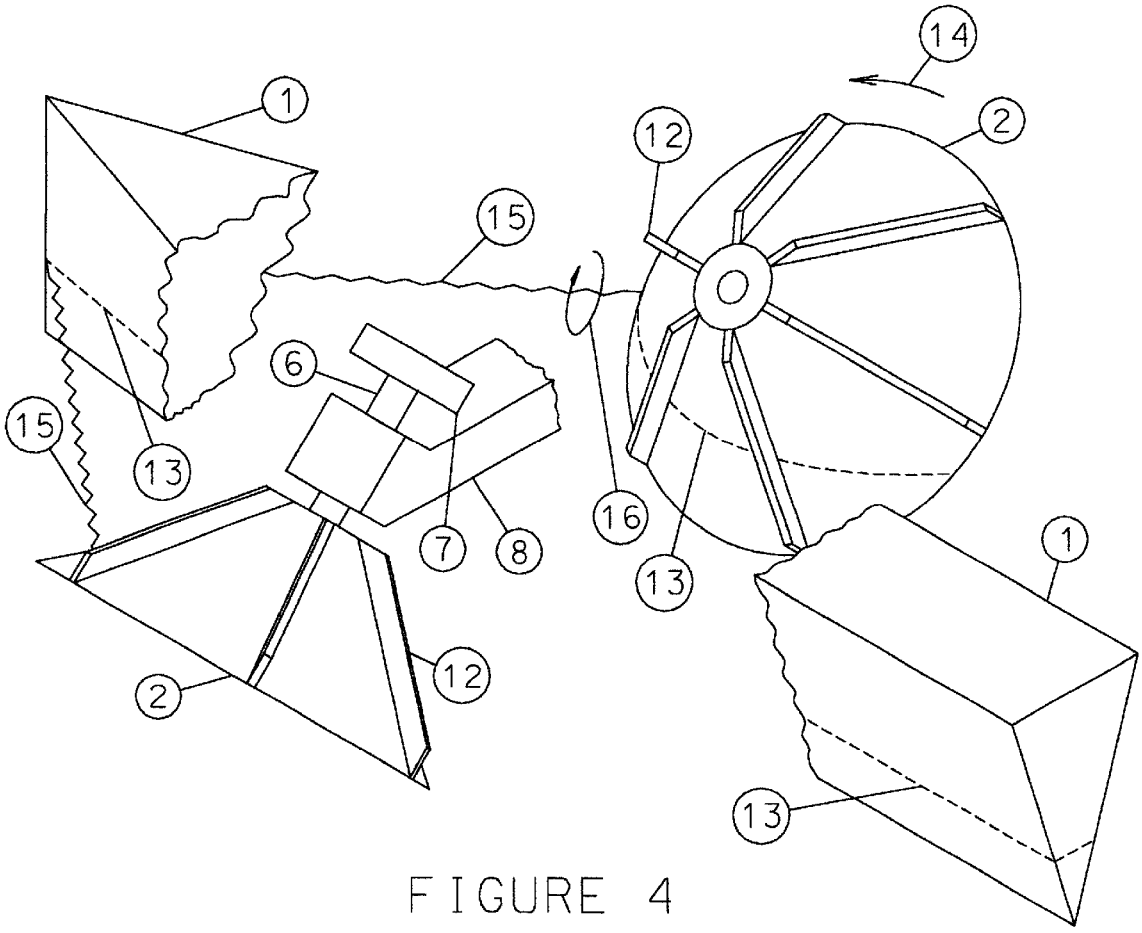
FIG. 4 is a modified isometric view with part of the central hull removed to show how a bow wave made by the central hull is intercepted by the active hulls.

FIG. 4 is a modified isometric view, in which, part of the central hull is removed to show that the location of the active hulls relative to the bow of the central hull can be arranged so that the bow waves 15 made by the central hull are intercepted by paddles of the active hulls. Where this interception occurs, the bow waves are in the form of vortexes, one of which is represented by 16. The orientation of a paddle, when the interception occurs, is such that the vortexes impart on the paddle a force that has a component that propels the hull forward. This is similar to action of the tail of a fish when the tail, on its return stroke, hits the vortex created when it was swinging in the other direction. The tail is in such a angular orientation that, when it hits the vortex, a forward push on the tail is obtained. In both cases, some of the otherwise wasted energy in the vortexes is recovered for forward propulsion. The overall propulsive efficiency is boosted.

Figure 5:
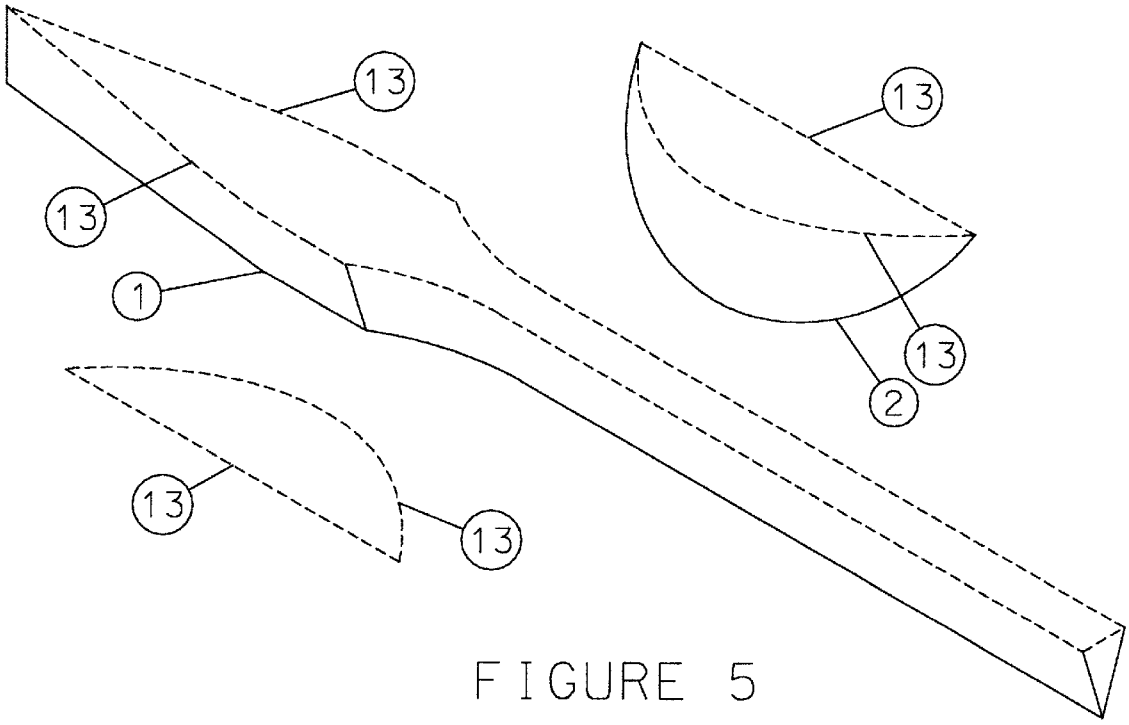
FIG. 5 is a modified isometric view showing only the immersed parts of the craft.

FIG. 5 is a modified isometric view showing immersed parts of the craft. The dashed lines represent the "foot prints" of the craft on the water. This view helps clarify the discussions on the other figures.

Figure 6:
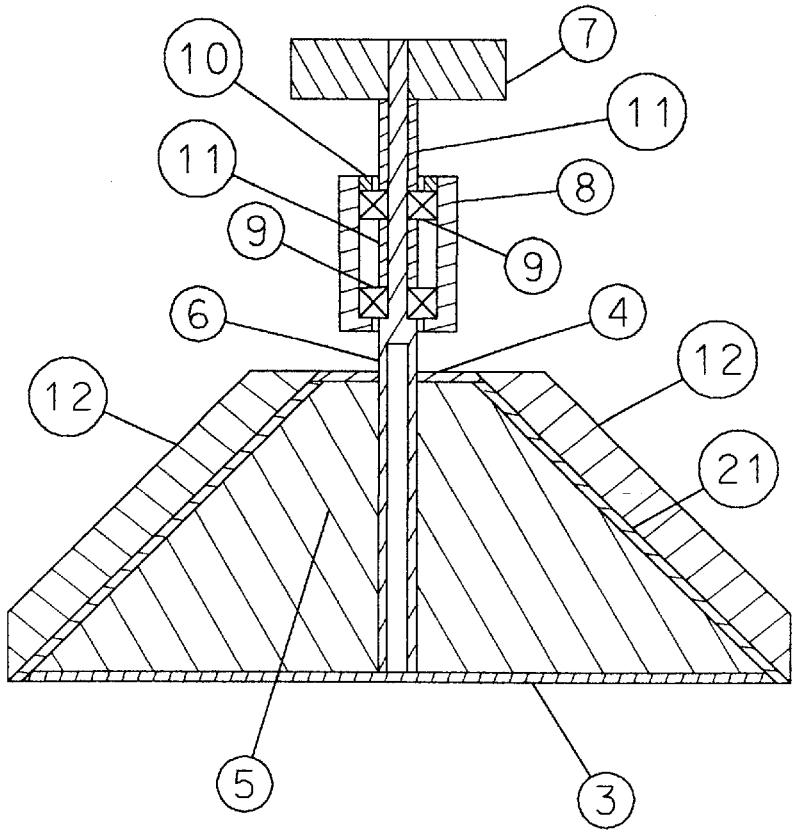
FIG. 6 is section A—A of FIG. 2 showing the detailed construction of one of the conical active hulls.

FIG. 6 is section A—A of FIG. 2. It shows that an example of construction of an active hull. The hull has the shape of a right circular cone 2 that is made of a thin and strong material. The base of the cone is covered by a circular base plate 3 that is made of the same material. The truncated top of the cone is covered by annular top plate 4 that is made of the same material. A central shaft 6 is attached to the conical box along the cone's axis of symmetry; the shaft protrudes above the top plate and terminates with a input pulley 7 affixed. The internal volume of the conical box is filled with a rigid plastic foam 5 or other light reinforcing material. The whole conical box is sealed water tight. The aim is to construct an active hull with minimum weight and minimum rotational inertia.

After attaching an appropriate number of paddles 12 to the conical surface, the assembly as described is supported by the lateral support beam 8 with the addition of two bearings 9, two spacing sleeves 11, one retaining ring 10 and an input pulley 7 at the end of the central shaft. This construction allows the conical active hull to have freedom only in rotation.

With the drawings of FIG. 1 through FIG. 6, especially with the orientation and direction of rotation of the active hulls shown, it is easier to demonstrate the superior hydrodynamic properties of a craft with active hulls.

The craft's forward movement is the result of the paddles of the rotating hulls sweeping the water in the direction that has a large component toward the rear of the craft and small component toward the center. The rearward component is related to the craft's propulsion; the inward component is the result of the paddles clearing away the majority, if not all, of the water that would otherwise obstruct the forward movement of the craft. The frontal drag on the hull will then be rather small. The water, which is carried rearward, will create very little friction drag on the conical surface of the active hulls.

The flat bases of the conical hulls, being parallel to the direction of travel, will encounter no frontal drag. The wetted surface of the bases will encounter some friction drag while moving forward through the water. The drag is small compared to the drag encountered if the bases are moved forward without rotation, because every part of the wetted surface has a velocity component in the direction of the on-coming water. Some parts have a component whose magnitude is larger than the speed of the water; some have component whose magnitude is smaller. The mean magnitude is somewhat less than the water speed. The base of the conical hulls will, therefore, encounter only a small amount of friction. Although it is small it constitutes the major part of the total drag on the hull and thus deserves a closer analysis.

To estimate more precisely the friction drag on a active conical hull, a mathematical analysis is essential. The analysis requires the graphic representation in FIG. 7, which is view B—B of FIG. 2 and shows the external surface of the base plate 3, the water level 13 and the arrow 14 representing the direction of rotation of the active hull. The area below 13 and within the circular edge of the base plate is the wetted area. The following calculations are based on two simple features: the top of the wetted surface is located at a distance below the center of the base plate equal to one fourth of the base plate radius and the tangential velocity of the base plate at the rim is twenty percent higher than the hull's forward velocity.

Figure 7:
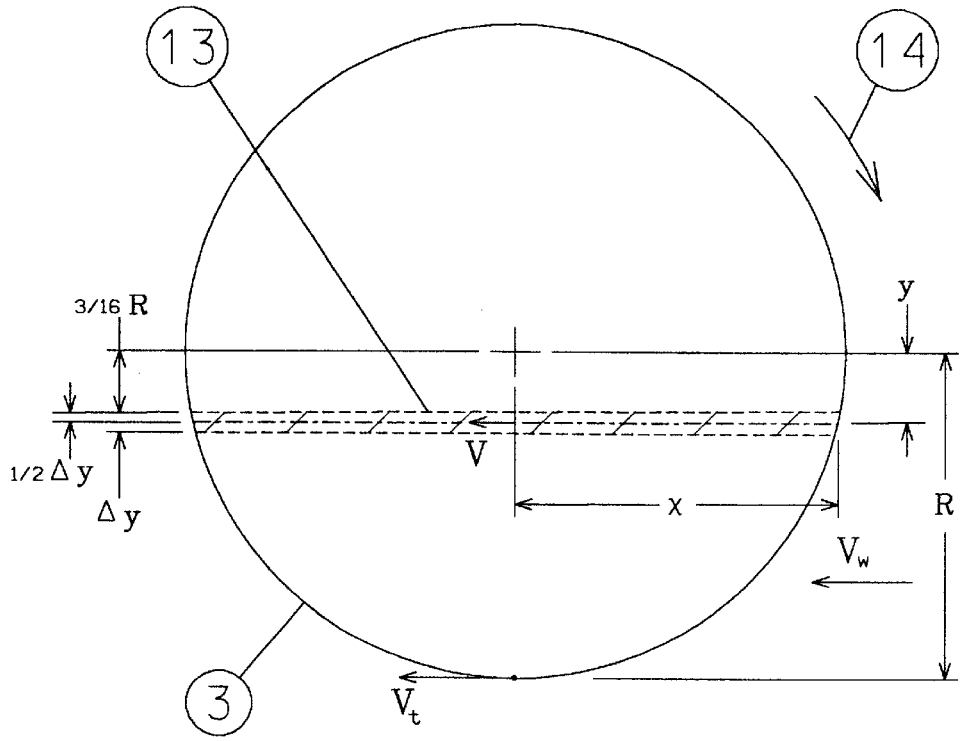
FIG. 7 is view B—B of FIG. 2 showing the flat external surface of the conical active hull's base plate. Mathematical markings are for numerical evaluations.

To obtain an estimate close enough to the real value, the wetted area is divided into ten horizontal elemental strips of equal height, Δy, as shown in FIG. 7. Friction drag is calculated for each of the ten elemental strips. Drag for the entire wetted area is obtained by summing the ten strips. These sums are done first for the case where the hull is rotating and then for the case where the hull is stationary and is pulled forward. The results are compared to reveal the drag reduction in the rotating case.

Nonmenclature

R Radius of the base plate.

x Half of the horizontal length of an elemental strip.

y Vertical distance of strip from the center of base plate.

Δy Height of strip.

V The velocity component of any part of the strip in the direction of the on-coming water (opposite to the travel of the hull).

$V_t$ Tangential velocity of the base plate at its rim.

Vw Velocity of the on-coming water.

$V_r$ Velocity of strip relative to Vw.

A Area.

D Friction drag.

K A constant.

Subscript n denotes the number of the strip.

Equations $$x_n=[R^2-y_n^2]^{1/2} \quad 1:$$

$$\Delta y=0.1(1-0.250)R=0.075R \quad 2:$$

$$y_n=y_{n-1}+\tfrac{1}{2}\Delta y \quad 3:$$

(except for the case where n=1: $y_1=0.250R+\tfrac{1}{2}\Delta y$)

$$V_t=1.2Vw \quad 4:$$

(because of the position of Vw in FIG. 7)

$$V_{r,n}=V_w-1.2V_w(y_n/R) \quad 5:$$

$$A_n=2x_n(\Delta y) \quad 6:$$

$$D_n=K(A_n)[V_{r,n}]^{1.5} \quad 7:$$

Results for the Case with Rotating Hull

| Strip | $y_n$ | $x_n$ | $A_n$ | $V_{r,n}$ | $D_n$ |
|---|---|---|---|---|---|
| 1 | 0.288R | 0.960R | $0.144R^2$ | $0.654V_w$ | $0.076K(R^2)[V_w]^{1.5}$ |
| 2 | 0.363R | 0.932R | $0.140R^2$ | $0.564V_w$ | $0.059K(R^2)[V_w]^{1.5}$ |
| 3 | 0.438R | 0.899R | $0.135R^2$ | $0.474V_w$ | $0.044K(R^2)[V_w]^{1.5}$ |
| 4 | 0.513R | 0.858R | $0.128R^2$ | $0.384V_w$ | $0.030K(R^2)[V_w]^{1.5}$ |
| 5 | 0.588R | 0.819R | $0.121R^2$ | $0.294V_w$ | $0.019K(R^2)[V_w]^{1.5}$ |
| 6 | 0.663R | 0.749R | $0.112R^2$ | $0.204V_w$ | $0.010K(R^2)[V_w]^{1.5}$ |
| 7 | 0.738R | 0.675R | $0.101R^2$ | $0.114V_w$ | $0.004K(R^2)[V_w]^{1.5}$ |
| 8 | 0.813R | 0.583R | $0.087R^2$ | $0.024V_w$ | 0 |

-continued

| Strip | $y_n$ | $x_n$ | $A_n$ | $V_{r,n}$ | $D_n$ |
|---|---|---|---|---|---|
| 9 | 0.888R | 0.460R | $0.069R^2$ | $-.066V_w$ | 0 |
| 10 | 0.963R | 0.270R | $0.041R^2$ | $-.156V_w$ | 0 |

The total friction drag = $D = 0.242K(R^2)[V_w]^{1.5}$
The total wetted area = $A = 1.200R^2$ Calculation for the Case with Non Rotating Hull Since there is no rotation, in equation 5, the second term describing rotation becomes zero:

$$V_{r,n}=V_w \quad 5:$$

$$\text{Total friction drag} = D = K(A)[V_w]^{1.5}$$
$$= 1.200K(R^2)[V_w]^{1.5}$$

Comparison of the Two Cases

The advantage of the rotating hull is apparent in the ratio of its drag and the drag of the non rotating hull:

$$\text{D-rotating/D-non-rotating} = 0.242K(R^2)[V_w]^{1.5}/1.2K(R^2)[V_w]^{1.5}$$
$$= 0.20$$

The friction drag of the active hull is only twenty percent of the inactive hull. Further reductions in drag may be accomplished by dimpling portions of the wetted surface to induce a slight turbulence which can provide a reduction in drag, similar to the dimples of a golf ball which reduce the air friction on a golf ball.

There are additional features which can be added to the present invention. Steering can be accomplished by driving each of its active hulls independently. Such a watercraft with a pair of active hulls and a central hull can be steered by the differential speed between the two active hulls. This configuration has outstanding maneuverability because it can turn sharply when the hulls are rotating in opposing directions.

Figure 8:
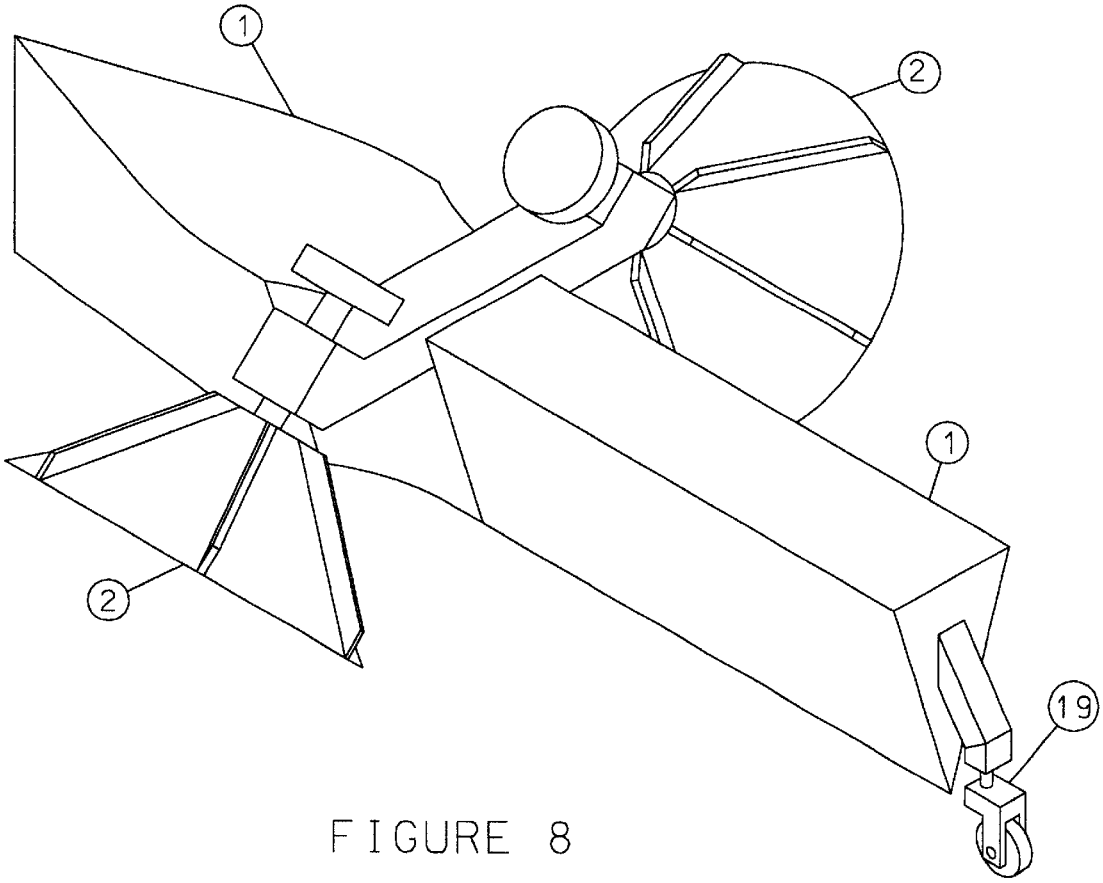
FIG. 8 is identical to FIG. 4 except for the addition of a rear swivel caster.

FIG. 8 is an isometric view same as FIG. 3 except that a retractable swivel caster 19 is added at the rear of the central hull. The addition allows the craft to move on land and to get in and out of the water by itself. The active hulls can be made detachable for easy transportation.

In addition, a variation of the present invention can utilize two or more pairs of active hulls in tandem, with or without the central hull.

Figure 9:
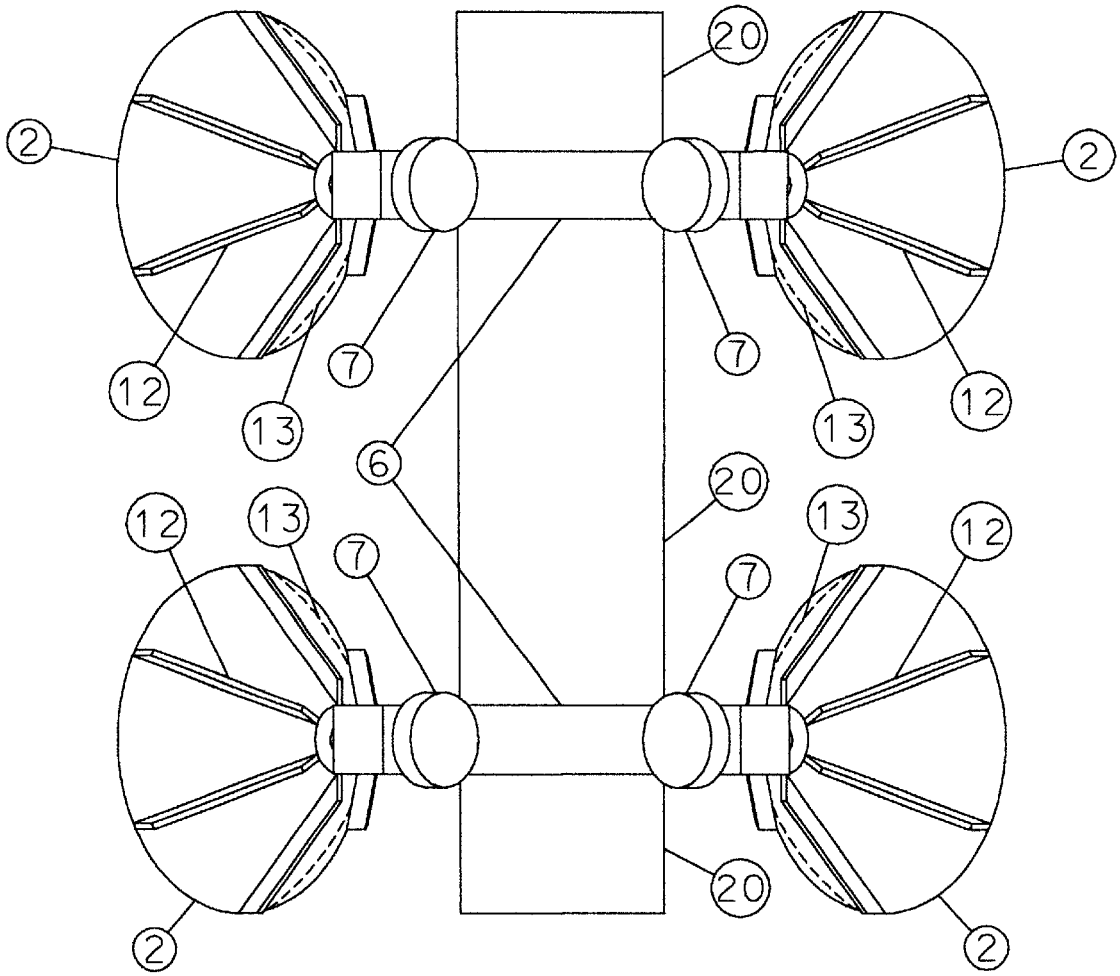
FIG. 9 is the plan view of a watercraft with two identical pairs of active hulls, with one pair behind the other.
Figure 10:
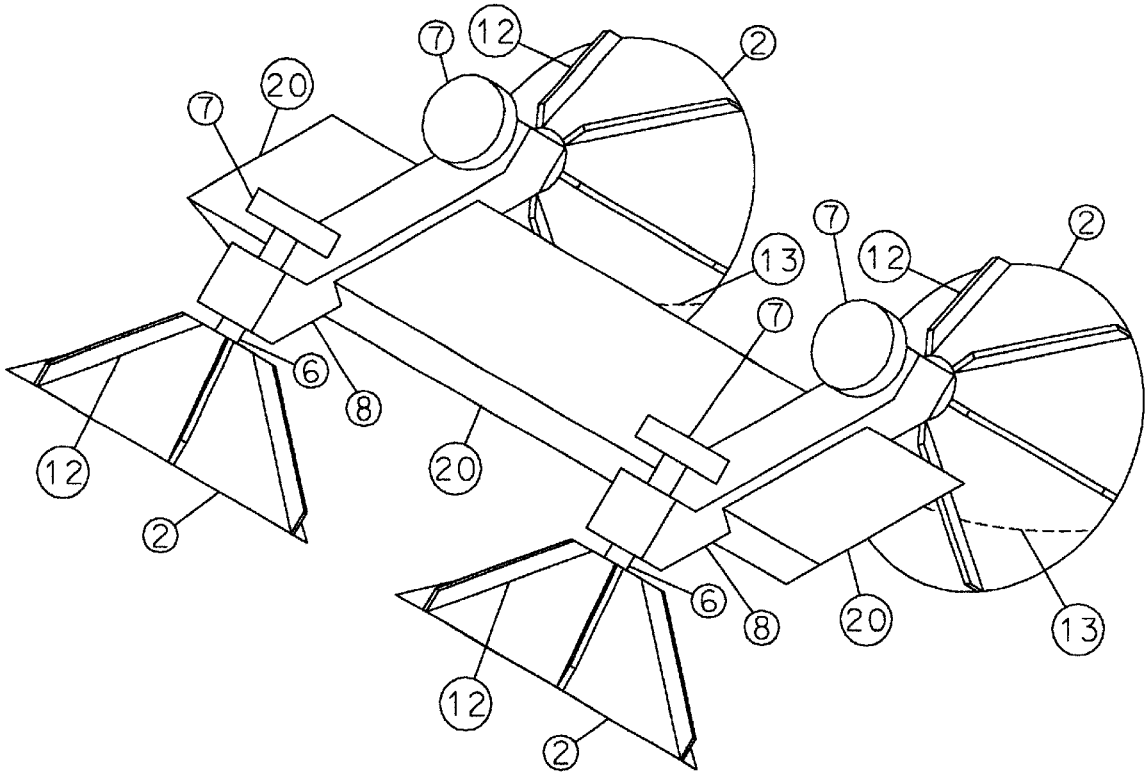
FIG. 10 is the elevation view of the craft in FIG. 9.
Figure 11:
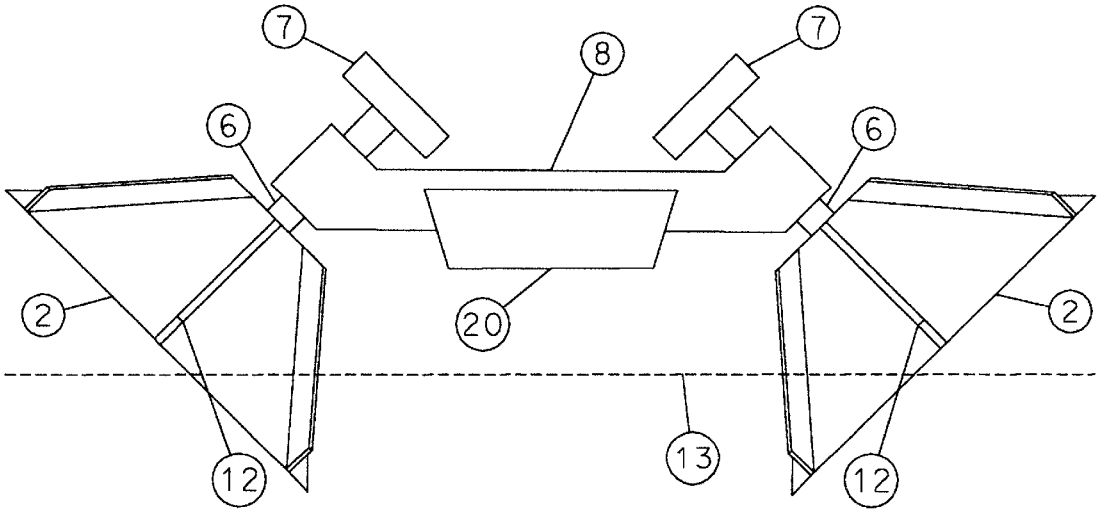
FIG. 11 is an isometric view of the craft in FIG. 9.

FIG. 9, FIG. 10 and FIG. 11 are respectively a plan view, an isometric view and elevation view of a craft with two pairs of active hulls, but no central hull. A longitudinal support beam 20 is used to link the two lateral support beams 8. All other components of the active hulls here are identified with the same numbers as appeared in the previous drawings of the present invention. Making crafts with more than two pairs of active hulls is just a matter of adding tandem pairs. All the advantages of the active hulls apply to this craft. However, without the central hull, the total hydrodynamic drag of this craft is further reduced. The hulls can be rotated independently and can be used for steering. Maneuverability is enhanced because the rotation of some hulls can be stopped or reversed. Crafts with two or more pairs of active hulls are naturally able to move on land and to get in and out of water by itself. The hulls can be made detachable for easy transportation.

Drawings of the present invention show a conical rotor with rectangular paddles attached. For ease of fabrication, and to reduce drag, the paddles may be integrated with the conical rotor by means of a casting and/or molding manufacturing process. Such integrated versions of the present invention may utilize a complex rotor shapes which vary significantly from a simple cone.

We claim:

1. A water craft comprising: at least one centrally-disposed longitudinally oriented hull, and at least one pair of rotatively driven active hulls, each of said active hulls having an axis of rotation positioned approximately forty-five degrees relative to the horizontal and projected laterally from said at least one longitudinally-oriented hull, each of said active hulls being of frusto-conical configuration, with planar end wall and each of said active hulls providing a buoyant force to said at least one longitudinally-oriented hull.

2. A water craft in accordance with claim 1, further comprising a plurality of paddles located on said frusto-conical surface of said at least one pair of active hulls.

3. A water craft in accordance with claim 1, said at least one longitudinally-oriented hull having angularly-disposed surfaces positioned in the areas of said active hulls, whereby water displaced by said active hulls includes a component which is directed against said angularly-disposed surfaces to be deflected to impart longitudinally-oriented forces to provide additional propulsive force to said at least one longitudinally-oreinted hull.

4. A water craft in accordance with claim 2, said at least one longitudinally-oriented hull having angularly-disposed surfaces positioned in the areas of said active hulls, whereby water displaced by said active hulls and water pushed by the paddles on said active hulls includes a component which is directed against said angularly-disposed surfaces to be deflected to impart longitudinally-oriented forces to provide additional propulsive forces to said at least one longitudinallly-oriented hull.

5. A water craft in accordance with claim 4, said at least one longitudinally-oriented hull having its longitudinal location relative to a nearest of said at least one pair of active hulls being fixed to allow said paddles on said at least one pair of active hulls upon their entering the water to intercept a maximum amount of bow waves created by said at least one longitudinally-oriented hull to convert the energy in said bow waves for propulsion.

* * * * *